US006776475B2

(12) United States Patent
O'Hara

(10) Patent No.: US 6,776,475 B2
(45) Date of Patent: Aug. 17, 2004

(54) INTERCONNECT SYSTEM AND METHOD FOR INKJET DEVICES USING CONDUCTIVE ELASTOMER

(75) Inventor: Steve A. O'Hara, Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/280,249

(22) Filed: Oct. 25, 2002

(65) Prior Publication Data

US 2004/0080577 A1 Apr. 29, 2004

(51) Int. Cl.[7] ..... B41J 2/14; B41J 2/16; B41J 2/05

(52) U.S. Cl. ..... 347/50; 347/58

(58) Field of Search ..... 347/50, 58

(56) References Cited

U.S. PATENT DOCUMENTS

| | | | |
|---|---|---|---|
| 5,461,482 | A | 10/1995 | Wilson et al. |
| 5,598,194 | A | 1/1997 | Hall et al. |
| 6,003,974 | A | 12/1999 | Wilson et al. |
| 6,231,168 | B1 | 5/2001 | Maze et al. |

OTHER PUBLICATIONS

Greenstein et al., "A 2.5 MHz 2D Array with Z–Axis Electrically Conductive Backing", Hewlett–Packard Laboratories, Palo Alto, CA; 9 pages.

Data Sheet, Shin–Etsu Polymer Co., Ltd., GB–E Type Inter–Connector, one page, http://www.shinpoly.co.jp/business/connector/apply_e/ic.htm.

Technology Trends, Using Conductive Elastomer Socketts for High Speed Packages, Chip Scale Review, Sep.–Oct. 2000, http://www.chipscalereview.com/issues/0900/techTrends.htm.

*Primary Examiner*—Thinh Nguyen

(57) ABSTRACT

An interconnect system for a device stall adapted to receive an inkjet device having a first set of electrical contact surfaces on a device surface. A second set of electrical contact surfaces is provided in a device stall. Respective ones of the first set and the second set are in facing alignment when the device is installed in the stall. An elastomeric layer is disposed between and in contact with the first and second sets of electrical contact surfaces, having a plurality of isolated conductive filaments or wires disposed therein between a first layer surface and a second layer surface. Conductor ends are exposed at the first and second layer surfaces, providing isolated electrical continuity between respective ones of the first set and the second set of electrical contact surfaces.

30 Claims, 4 Drawing Sheets

INTERCONNECT SYSTEM AND METHOD FOR INKJET DEVICES USING CONDUCTIVE ELASTOMER

BACKGROUND OF THE DISCLOSURE

Print cartridges are typically mounted in a stall or chute for positioning in relation to a print zone. The cartridge and the stall are each provided with electrical contacts, so that an electrical interconnect between the cartridge and the stall can be established. In many print cartridges, the cartridge electrical contacts are provided on a THA, a TAB (Tape Automated Bonded) head assembly, flexible circuit which is bonded to the cartridge body. The stall also typically has a flexible circuit board with electrical contacts which are located to make contact with corresponding contacts on the THA circuit on the cartridge. The circuit contacts are typically copper or nickel contacts, which would be subject to corrosion. A gold or other protective metal layer, e.g. palladium, is formed over the copper or nickel contacts, to prevent corrosion. A thick gold layer, e.g. on the order of 30 microinches in thickness, is typically electroplated onto the contacts in order to survive multiple insertions of the cartridge into the stall, since gold wears off with every insertion. This adds to the expense of the print cartridge.

SUMMARY OF THE DISCLOSURE

An interconnect system for a device stall adapted to receive an inkjet device having a first set of electrical contact surfaces on a device surface. A second set of electrical contact surfaces is provided in a device stall. Respective ones of the first set and the second set are in facing alignment when the device is installed in the stall. An elastomeric layer is disposed between and in contact with the first and second sets of electrical contact surfaces, having a plurality of isolated conductive filaments or wires disposed therein between a first layer surface and a second layer surface. Conductor ends are exposed at the first and second layer surfaces, providing isolated electrical continuity between respective ones of the first set and the second set of electrical contact surfaces.

BRIEF DESCRIPTION OF THE DRAWINGS

Features and advantages of the disclosure will readily be appreciated by persons skilled in the art from the following detailed description when read in conjunction with the drawing wherein.

DETAILED DESCRIPTION OF THE DISCLOSURE

Figure 1A:
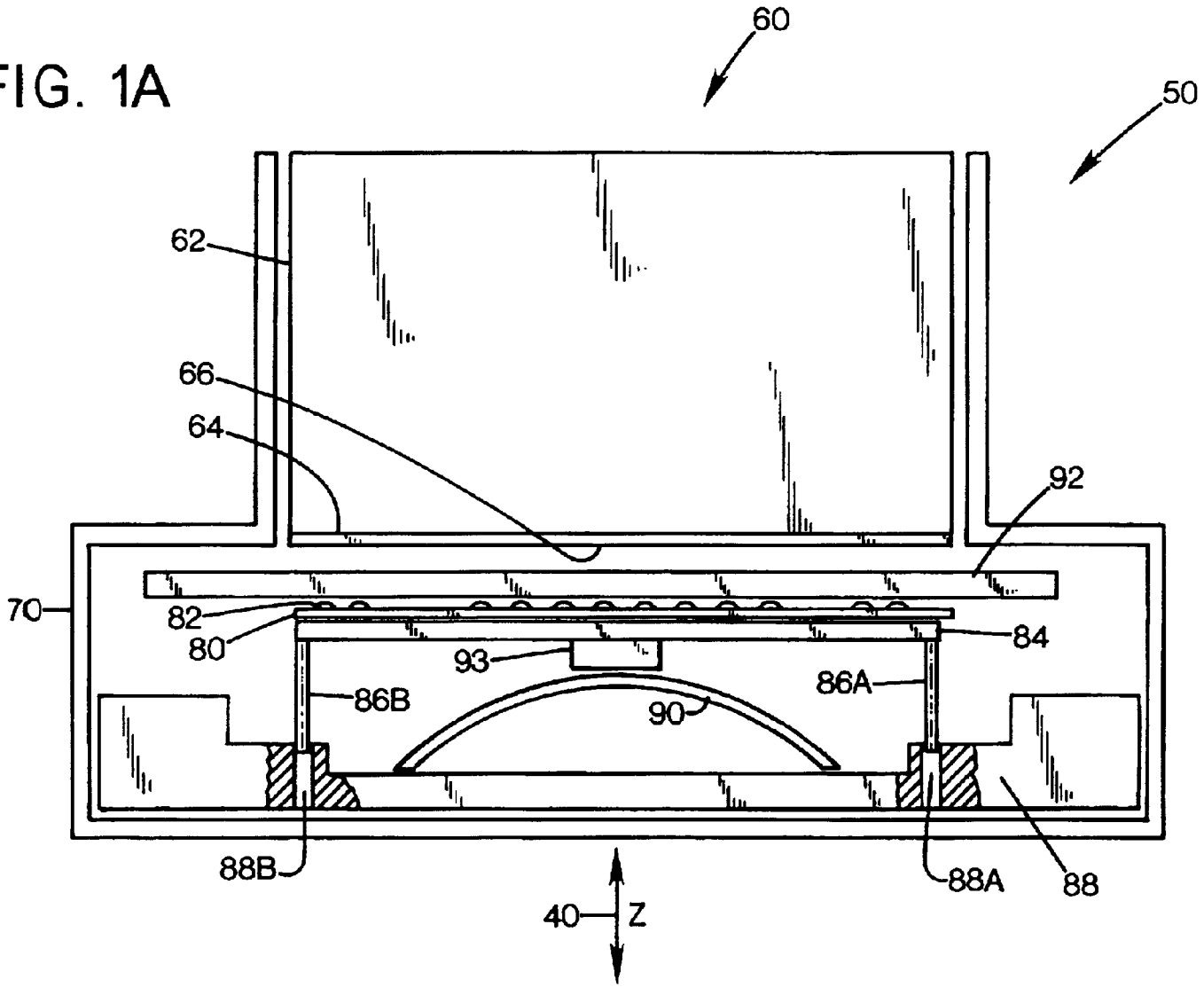
FIG. 1A is a side view illustrating an exemplary embodiment of an interconnect system using a conductive z-axis elastomer, showing a print cartridge in a stall, just above an engaged position.

In the following detailed description and in the several figures of the drawing, like elements are identified with like reference numerals.

Figure 1B:
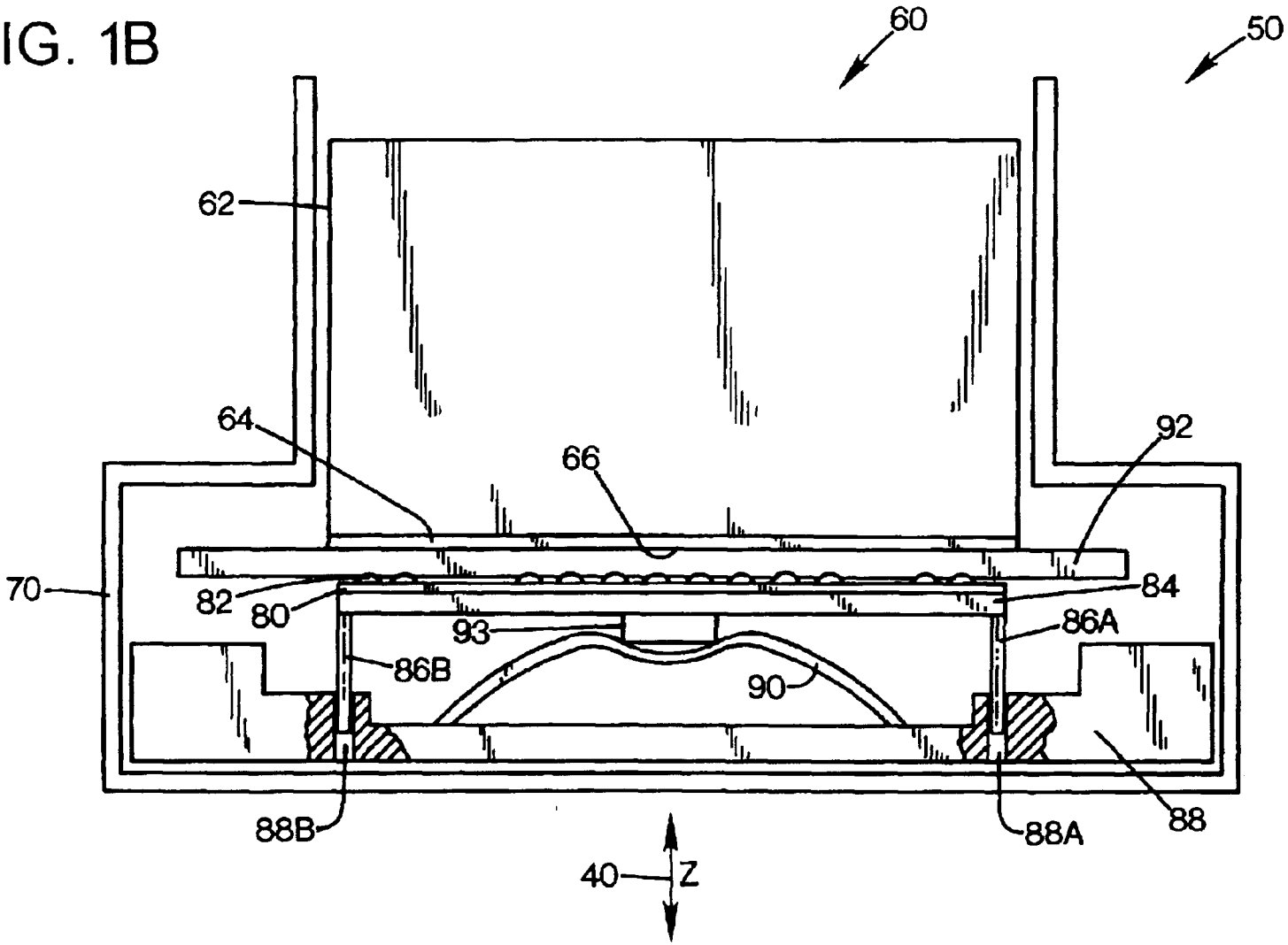
FIG. 1B is a side view similar to FIG. 1A, but showing the print cartridge in an engaged position with stall electrical contacts.
Figure 2:
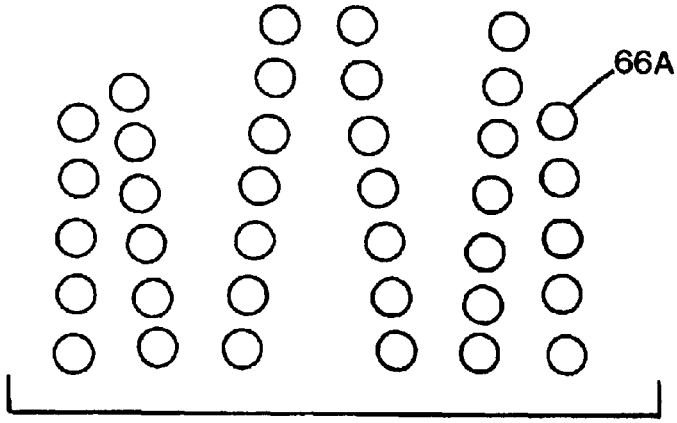
FIG. 2 depicts an exemplary layout of a set of flat contacts mounted on the print cartridge of FIG. 1.

FIGS. 1A–1B illustrate in schematic fashion an exemplary embodiment of an interconnect system employing the invention. An inkjet print cartridge 60 is mounted in a stall 70 during printing operations. The stall can be fixed in position on the printer, or more typically, fabricated on a movable carriage. To energize the cartridge printhead (not shown in FIG. 1), an electrical interconnect is made with the cartridge when it is in the mounted position. The print cartridge includes a body 62 with a body surface 64 on which a TAB circuit 66 is mounted. The circuit 66 includes a planar set of spaced gold or palladium plated flat contacts. An exemplary layout of a set of contacts 66A is shown in FIG. 2. In this exemplary embodiment, the contacts 66A have a nominal diameter of 1.4 mm, and have a minimum spacing of 0.20 mm between contacts, but larger or smaller contacts, with different spacings, can be employed as well.

The interconnect system 50 includes a set of gold plated dimple contacts 82 fabricated on substrate 80. It will be appreciated that the use of cartridge-mounted flat contacts which mate against a corresponding set of dimple contacts on a carriage to establish an electrical interconnect is well known. In the exemplary embodiment, the dimple contacts are nominally 0.8 mm rounded dimples which protrude 0.15 mm from the substrate surface, but larger or smaller contacts can be used, depending on requirements for a particular application.

The substrate 80 is mounted on a stiff plate 84, which in turn is mounted for movement along a limited range of movement along the Z axis 40. In this exemplary embodiment, the plate 84 is mounted to a sliding bracket comprising walls or posts 86A, 86B, which slide in grooves or holes 88A, 88B formed in housing 88. In one exemplary embodiment, the range of movement in the Z axis is on the order of 1.0 to 1.5 mm, although larger or smaller ranges of movement may be employed, depending on the application requirements. The stiff plate on its sliding bracket has a standoff block 93 mounted to its lower surface, and is biased to an extended position by a dome structure 90 which contacts the block 93. Dome springs are used for such purposes as biasing push-button switches, for example. In contrast to these "snap" switches, however, the dome structure 90 is fabricated to provide a substantially constant bias force against the stiff plate when it is placed under compression. The plate 84 and its support thus allow some compliant movement of the substrate 80 in response to insertion forces occurring during mounting of the print cartridge 60. The compliant movement is needed to accommodate the tolerances affecting the fit between the various components of the interconnect system and its mounting structures.

Instead of bringing the cartridge flat contacts 66 into direct contact with the dimple contacts 82, a Z axis conductive elastomer layer 92 is interposed between contacts 66 and 82. In one exemplary embodiment, the layer 92 is simply laid in place without mechanical attachment, although other applications may employ means for holding the layer 92 in place, such as adhesive or mechanical attachment. The layer 92 has isolated, conductive elements arranged in alignment with the Z axis, such as thin wires potted in an insulator, which have exposed contacts on the upper and lower surfaces of the layer 90. Z-axis conductive elastomer layers are commercially available, e.g., the GB matrix line of conductive elastomers marketed by Shin-Etsu Polymer America, Inc., Newark, Calif. The thickness of the layer and the pitch spacing of conductors in the layer are determined according to parameters of a given application. For one exemplary application, the layer has a layer thickness of 0.5 mm, and a conductor pitch of 0.1 mm.

Figure 3:
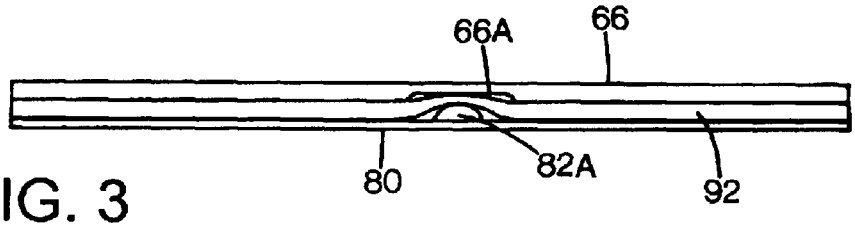
FIG. 3 is a diagrammatic side view illustration of an exemplary interaction between a flat contact on the print cartridge, a dimple contact on the cartridge stall, and the Z axis conductive elastomer layer.

FIG. 1A shows the print cartridge 60 partially inserted into the stall 70, but not fully seated, so that the contacts 66A are not brought into contact with the layer 92. FIG. 1B shows the cartridge 60 fully seated in the stall 70, with the contacts 66A on circuit 66 seated in compression against layer 92. The stall 70 typically has datum contact points (not shown) which interface against corresponding datum surfaces (not shown) on the print cartridge 60, to accurately locate the cartridge 60 in the stall 70, with some type of detent or latch mechanism (not shown) to hold the cartridge 60 in its located position shown in FIG. 1B. The compression force against the layer 92 in turn creates a compression force of layer 92 against the dimple contacts 82. This is shown in FIG. 3 for exemplary contacts 66A and 82A.

Figure 5:
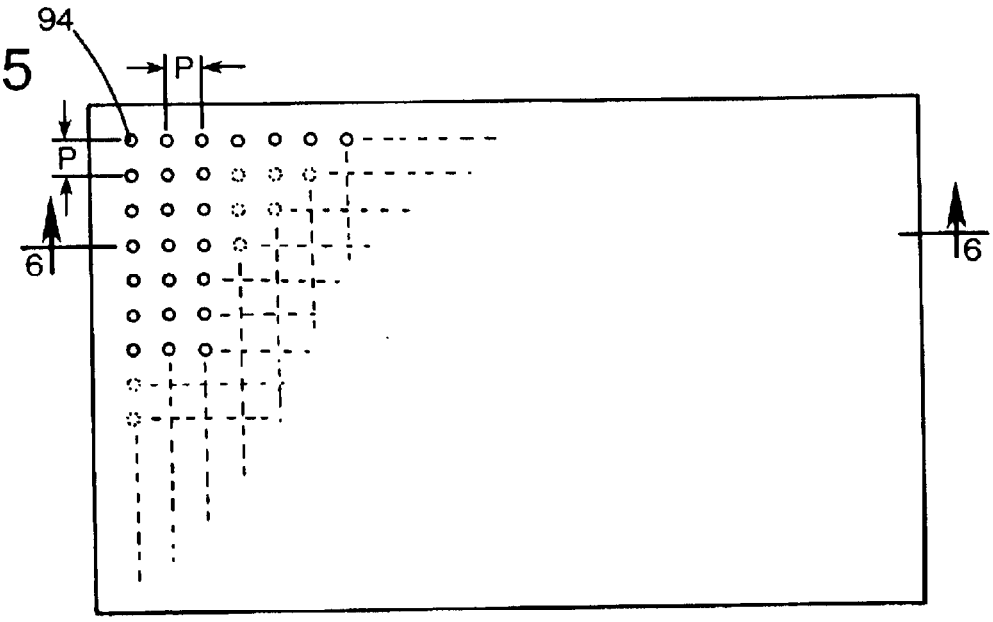
FIG. 5 is an exemplary embodiment of the elastomer layer of the interconnect system.
Figure 6:
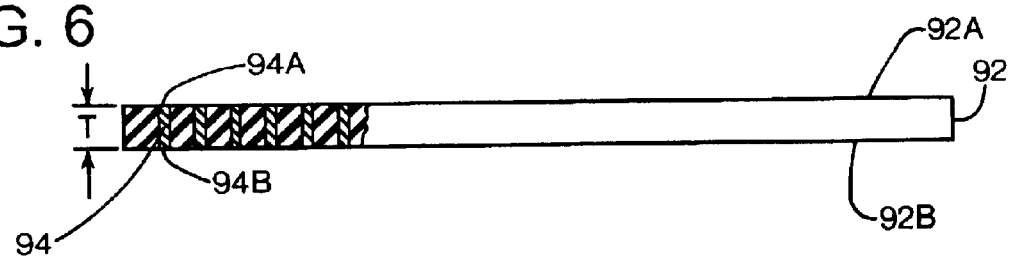
FIG. 6 is a simplified cross-sectional view taken along line 6—6 of FIG. 5.

An exemplary embodiment of the elastomer layer 92 is illustrated further in the top view of FIG. 5 and the simplified cross-sectional view of FIG. 6. The layer 92 has a matrix of electrically conductive filaments 94 which are surrounded by dielectric material such as silicon rubber. The filaments provide one-directional (Z-axis only) conductive paths, without cross-conducting in the X or Y axes. The filaments extend between the opposed broad surfaces 92A, 92B of the layer 92, so that ends 94A, 94B of the filaments are exposed on the surfaces. The filaments are arranged in spaced relation forming a filament matrix, of pitch p. The filaments are stiffer than the elastomer material, and so when the elastomer layer is compressed, the ends of the filaments can make contact with surfaces in compression against the surfaces of the layer. In one exemplary embodiment, the distribution of filaments in the layer is uniform. However, for some applications, the filament distribution can be custom designed to conform to the contact pattern with which the filaments will make contact.

Figure 4:
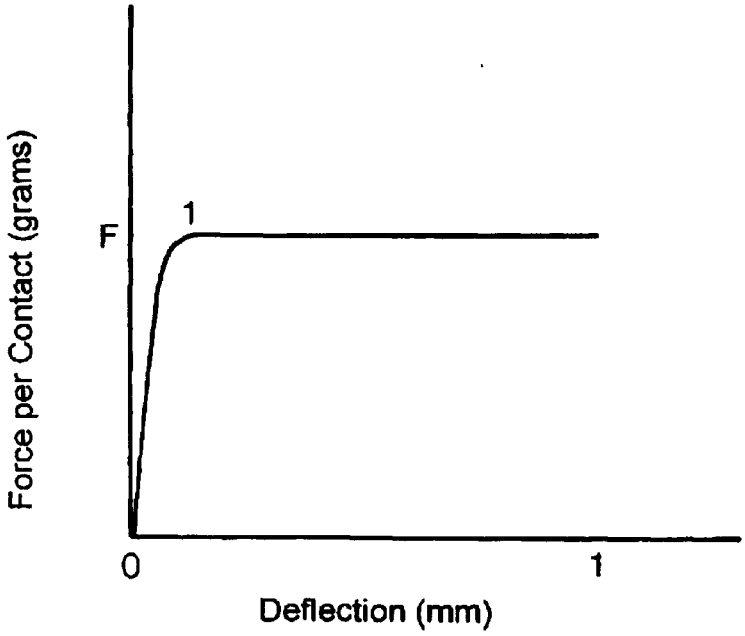
FIG. 4 shows an exemplary force versus deflection characteristic, for force exerted on a single contact by the spring of the system of FIG. 1A.

The dome spring 90 is fabricated to provide a constant force on each contact over its limited range of expected movement. FIG. 4 shows an exemplary suitable force versus deflection characteristic, for force exerted on a single contact by the spring. Other spring structures could alternatively be used, e.g., a washer spring or an elastomer spring. For some applications, the spring 90 can be omitted, and the elastomer layer 92 provides sufficient resilience and spring pressure to take up any tolerances in the fit between the cartridge and the carriage contacts. In this case, the layer 92 can be made thicker to provide sufficient resilience.

The elastomer layer 92 serves as a buffer layer between the flat contacts 66A and the dimple contacts 82, preventing direct mechanical contact between the respective sets of contacts, while providing an electrical path between conductive contacts aligned in the Z axis with respect to one another. As a result, wear on the respective sets of contacts 66A, 82 is significantly reduced, allowing the thickness of the gold or other protective layer to be substantially reduced. This provides a cost saving in reduced material cost, and also savings in the manufacturing process. Instead of electroplating a relatively thick layer of gold onto the contacts, a relatively thin layer can be applied by an immersion process, also known as a flash process. For example, a layer on the order of 2 micro-inches to 4 micro-inches can be employed in one application, rather than an electroplated gold layer of 30 micro-inch thickness.

Another function provided by the layer 92 is a shielding function, wherein the layer 92 shields both sets of electrical contacts from the environment, reducing corrosion. In applications such as inkjet printers, stray ink droplets and spray can come into contact with the elements such as the carriage, and the layer 92 which shields both sets of contacts can reduce or eliminate the contact exposure to particles and moisture.

Figure 7:
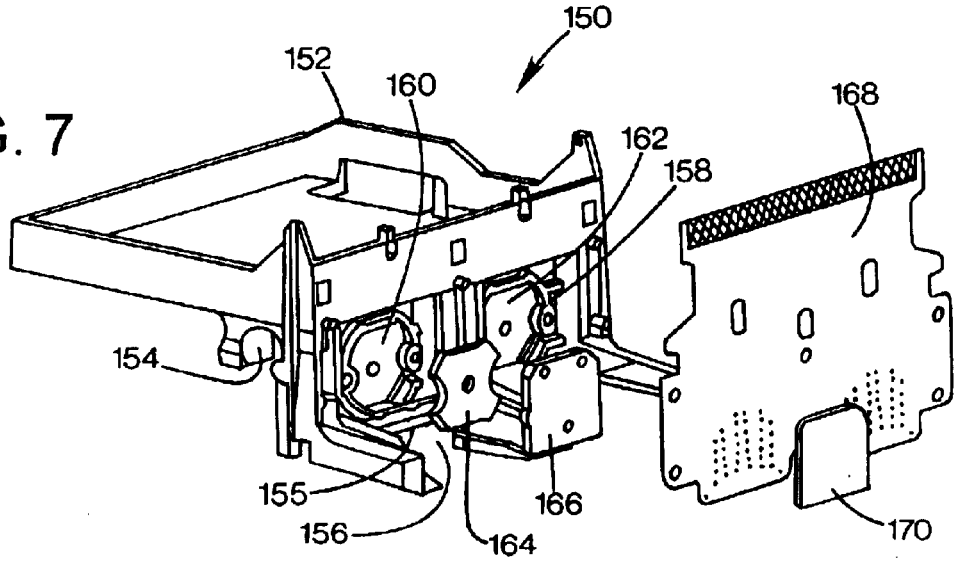
FIG. 7 is an exploded isometric view of an exemplary embodiment of a printer carriage employing an interconnect system in accordance with the invention.

An exemplary application for an interconnect system in accordance with the invention is in a swath type printer having a movable carriage mounted on a slider rod. FIG. 7 is a simplified exploded isometric view of an exemplary carriage structure 150 which is adapted to employ an interconnect system according to the invention. This carriage structure comprises a body 152, typically fabricated of an engineering plastic material. The body is provided with rod bracket features 154 for mounting the carriage for sliding movement along a carriage slider rod. The carriage 150 in this example is adapted with two stalls indicated generally as stalls 156, 158 formed in the carriage base 155. A print cartridge (not shown in FIG. 7) will be mounted in each stall. Of course, in other embodiments, the carriage can hold a single cartridge, or more that two cartridges, e.g., four or more. Each stall 156, 158 has defined therein a pocket 160, 162 for receiving a dome spring member. For clarity, only parts for the stall 156 are shown in FIG. 7. The spring member 164 is placed in pocket 160, and a stiff plate 166 is fitted over the spring member. A flexible circuit board 168 is fitted over the plates, and carries the dimple electrical contacts. The circuit board 168 includes circuit traces which typically connect to a wiring ribbon leading to a printer controller board (not shown), in an exemplary embodiment. A Z axis conductive elastomer layer 170 is placed over the dimple contacts, for making contact with the print cartridge electrical contacts when the print cartridge is installed into the carriage. Alignment pins (not shown) can be used to align the flexible circuit board and the elastomer layer.

Although the foregoing has been a description and illustration of specific embodiments of the invention, various modifications and changes thereto can be made by persons skilled in the art without departing from the scope and spirit of the invention as defined by the following claims. For example, while the interconnect system has been described for use in a print cartridge stall, it can also be used in other applications, such as a stall for an ink supply which has electrical contacts.

What is claimed is:

1. An interconnect system for a device stall adapted to receive a removable inkjet device having a first set of electrical contact surfaces on a device surface, comprising:

a second set of electrical contact surfaces in the device stall;

respective ones of the first set and the second set in facing alignment when the device is installed in the device stall;

an elastomeric layer disposed between and in contact with said first set of electrical contact surfaces and said second set of electrical contact surfaces, when the inkjet device is positioned in the stall, said elastomeric layer having a plurality of aligned conductive filaments or wires disposed therein between a first layer surface and a second layer surface, and having conductor ends exposed at the first and second layer surfaces, providing isolated electrical continuity between said respective ones of the first set and the second set of electrical contact surfaces.

2. The system of claim 1, further comprising:

a spring structure providing a bias force against said second set of electrical contact surfaces through a deflection range.

3. The system of claim 2, wherein the spring structure provides a substantially constant bias force over said deflection range.

4. The system of claim 3, wherein the spring structure comprises a dome spring element.

5. The system of claim 2, wherein said second set of electrical contact surfaces is fabricated on a first surface of a flexible circuit board, and said spring structure is disposed to exert said bias force on a second surface of the flexible circuit board.

6. The system of claim 5, wherein the spring structure comprises:

a stiff plate contacting the second surface of the flexible circuit board;

a suspension structure for suspending the stiff plate relative to a stall base;

a spring element disposed between the plate and the stall base.

7. The system of claim 1, wherein the device is an inkjet print cartridge.

8. The system of claim 7, wherein the stall is formed in a movable carriage.

9. The system of claim 1, wherein said first set of contact surfaces have a layer of gold or palladium formed therein in a thickness range of 2 micro inches to 4 micro inches.

10. The system of claim 1, wherein said second set of contact surfaces have a layer of gold or palladium formed therein in a thickness range of 2 micro inches to 4 micro inches.

11. The system of claim 1, wherein said first set of contact surfaces includes flat contact surfaces, and said second set of contact surfaces includes protruding dimple contact surfaces.

12. The system of claim 1, wherein the elastomeric layer includes a dielectric elastomer material in which the plurality of conductive filaments or wires are embedded to provide electrical isolation in directions transverse to the filaments or wires.

13. The system of claim 1, wherein respective ones or groups of the conductor ends make electrical contact with the first set and the second set of electrical contact surfaces.

14. The system of claim 1, wherein the elastomeric layer shields the first set of contacts and the second set of contacts from environmental contamination when the inkjet device is positioned in the stall.

15. An interconnect system for an inkjet print cartridge having a first set of electrical contact surfaces on a cartridge surface, comprising:

a second set of electrical contact surfaces in a cartridge stall;

respective ones of the first set and the second set in facing alignment when the cartridge is installed in the cartridge stall; and an elastomeric layer disposed in compression between said first set of electrical contact surfaces and said second set of electrical contact surfaces, said elastomeric layer having a plurality of isolated conductive filaments or wires disposed therein between a first layer surface and a second layer surface, and having conductor ends exposed at the first and second layer surfaces, providing one-dimensional electrical continuity between said respective ones of the first set and the second set of electrical contact surfaces.

16. The system of claim 15, further comprising:

a spring structure providing a bias force against said second set of electrical contact surfaces through a deflection range.

17. The system of claim 16, wherein the spring structure provides a substantially constant bias force over said deflection range.

18. The system of claim 17, wherein said second set of electrical contact surfaces is fabricated on a first surface of a flexible circuit board, and said spring structure is disposed to exert said bias force on a second surface of the flexible circuit board.

19. The system of claim 17, wherein the spring structure comprises:

a stiff plate contacting the second surface of the flexible circuit board;

a suspension structure for suspending the stiff plate relative to a stall base;

a spring element disposed between the plate and the stall base.

20. The system of claim 19, wherein the spring structure comprises a dome spring element.

21. The system of claim 16, wherein said first set of contact surfaces have a layer of gold or palladium formed therein in a thickness range of 2 micro inches to 4 micro inches.

22. The system of claim 16, wherein said second set of contact surfaces has a layer of gold or palladium formed therein in a thickness range of 2 micro inches to 4 micro inches.

23. The system of claim 16, wherein said cartridge set of contact surfaces includes flat contact surfaces, and said stall set of contact surfaces includes protruding dimple contact surfaces.

24. The system of claim 16, wherein the elastomeric layer has a thickness of about 0.5 mm.

25. An interconnect system for an inkjet print cartridge having a first set of electrical contact surfaces on a cartridge surface, comprising:

a second set of electrical contact surfaces in a cartridge stall;

respective ones of the first set and the second set in facing alignment when the cartridge is installed in the cartridge stall;

buffer means disposed between the first set of contacts and the second set of contacts for preventing direct physical contact between the first set and the second set and for providing one-dimensional electrical continuity between said respective ones of the first set and the second set of electrical contact surfaces.

26. The system of claim 25, wherein said buffer means comprises an elastomeric layer disposed in compression between said first set of electrical contact surfaces and said second set of electrical contact surfaces.

27. An interconnect system for an inkjet print cartridge having a first set of electrical contact surfaces on a cartridge surface, comprising:

a second set of electrical contact surfaces in a cartridge stall;

respective ones of the first set and the second set in facing alignment when the cartridge is installed in the cartridge stall;

buffer means disposed between the first set of contacts and the second set of contacts for preventing direct physical contact between the first set and the second set and for providing one-dimensional electrical continuity between said respective ones of the first set and the second set of electrical contact surfaces, said buffer means comprising an elastomeric layer disposed in compression between said first set of electrical contact surfaces and said second set of electrical contact surfaces, wherein said elastomeric layer has a plurality of isolated conductive filaments embedded in the elastomeric layer between a first layer surface and a second layer surface, and having conductor ends exposed at the first and second layer surfaces.

28. A method for electrically connecting an inkjet device in a device stall, comprising:

inserting the device into the device stall;

contacting a first surface of a dielectric elastomer layer with a device set of electrical contact surfaces on a device body, said elastomeric layer having a plurality of aligned conductive filaments or wires disposed therein between the first layer surface and a second layer surface, and having conductor ends exposed at the first and second layer surfaces;

compressing the dielectric elastomer layer between the device set of electrical contact surfaces and a stall set of electrical contacts, said stall set of electrical contacts in contact with the second layer surface, providing isolated electrical continuity between said respective ones of the device set of electrical contacts and the stall set of electrical contact surfaces without making direct physical contact between said respective ones of said device and said stall contacts.

29. The method of claim 28, wherein the cartridge set of electrical contact surfaces includes flat contact surfaces, and the stall set of electrical contact surfaces include protruding dimple contact surfaces.

30. A method for electrically connecting a print cartridge in a cartridge stall, comprising:

inserting the print cartridge into the cartridge stall;

contacting a first surface of a dielectric elastomer layer with a cartridge set of electrical contact surfaces on a print cartridge body, said elastomeric layer having a plurality of aligned conductive filaments or wires disposed therein between the first layer surface and a second layer surface, and having conductor ends exposed at the first and second layer surfaces;

compressing the dielectric elastomer layer between the cartridge set of electrical contact surfaces and a stall set of electrical contacts, said stall set of electrical contacts in contact with the second layer surface, providing isolated electrical continuity between said respective ones of the cartridge set of electrical contacts and the stall set of electrical contact surfaces without making direct physical contact between said respective ones of said device set of electrical contacts and said stall set of electrical contacts.

* * * * *